US009888750B2

(12) United States Patent
Farnum et al.

(10) Patent No.: US 9,888,750 B2
(45) Date of Patent: Feb. 13, 2018

(54) MANUAL TOOL FOR PRECISION FORMING OF EAR WIRES FOR JEWELRY

(71) Applicant: DPG USA, Inc., Schaumburg, IL (US)

(72) Inventors: Ronald Carl Farnum, Lombard, IL (US); John C. Olson, Livingston, TX (US); David O. Meyers, East Layton, UT (US)

(73) Assignee: DPG USA INC., Schaumburg, IL (US)

( * ) Notice: Subject to any disclaimer, the term of this patent is extended or adjusted under 35 U.S.C. 154(b) by 266 days.

(21) Appl. No.: 14/706,443

(22) Filed: May 7, 2015

(65) Prior Publication Data

US 2015/0321243 A1 Nov. 12, 2015

Related U.S. Application Data

(60) Provisional application No. 61/989,613, filed on May 7, 2014.

(51) Int. Cl.

| | |
|---|---|
| ***B21F 1/00*** | (2006.01) |
| ***A44C 27/00*** | (2006.01) |
| ***B21F 45/00*** | (2006.01) |
| *B21F 1/06* | (2006.01) |

(52) U.S. Cl.

CPC ..... *A44C 27/00* (2013.01); *B21F 1/002* (2013.01); *B21F 45/00* (2013.01); *B21F 1/06* (2013.01)

(58) Field of Classification Search

CPC ... B21F 1/002; B21F 1/06; B25B 7/12; A44C 27/00; A44C 27/001; B21D 53/44

See application file for complete search history.

(56) References Cited

U.S. PATENT DOCUMENTS 7,032,627 B1 * 4/2006 Sheriff ..... B21F 1/002 140/102.5

2009/0313835 A1 * 12/2009 Erbrick ..... B23D 21/10 30/251

* cited by examiner

*Primary Examiner* — Debra Sullivan

(74) *Attorney, Agent, or Firm* — Robert S. Alexander; Ferrells, PLLC; Anna L Kinney

(57) ABSTRACT

A tool is provided for bending wire for use in earrings. The tool has a two handles; an anvil plate; two terraced floating bars; two forming links, each having a stanchion projecting therefrom and a forming link rod projecting from the first forming link; an upper and lower linkage arm; a translating pin; and a planetary gear having an eccentric forming rod projecting from its lower face. The anvil plate has a longitudinal slot and arcuate minor and major forming slots formed therethrough; a circumferential gear formed on one side of the anvil plate, adjacent and exterior to the major forming slot, spanning less than 360°; and a retaining wall and a forming anvil formed on the other side of the anvil plate. The handles are pivotally joined to the anvil plate such that the forming link rod and a stanchion engage a wire lying against the retaining wall.

4 Claims, 14 Drawing Sheets

116
31
112
110
114
102
30
104
36
150
118
38
100
124
154
152
122
26
40
108
120
44
128
42
130
46
132
134
146
140
148
127
48
144
126
50
142
32
158
156
52

MANUAL TOOL FOR PRECISION FORMING OF EAR WIRES FOR JEWELRY

CLAIM FOR PRIORITY

This Non-Provisional patent application is based on U.S. Provisional Patent Application Ser. No. 61/989,613, of the same title, filed on May 7, 2014, the priority of which is claimed, and the disclosure of which is incorporated by reference.

BACKGROUND OF THE INVENTION

Beading is a hobby which had become highly popular for forming unique, inexpensive decorative items of adornment. As beaders progress in their level of skill, it becomes increasingly important to them to produce items of high quality and professional appearance even though they are often given away to grand children and other family members. To this end, beading supplies are offered to ensure that the beaded items have a quality that would be considered attractive by the intended wearers. However, these supplies must also be inexpensive and easily manipulable by the intended users even if hampered by arthritis and failing strength. Ear rings for pierced ears have been quite difficult for beaders to produce to levels of quality that they would consider acceptable, particularly because hand formed wires simply do not meet the expected level of appearance that can be obtained with other commonly produced beaded items, particularly bracelets and necklaces. The large loop in a standard ear wire is particularly difficult to form using tools heretofore available to beaders. However, even if the beader purchases preformed ear wires, those items commonly sold still require the beader to form bends or kinks in the ear wire which can be difficult to form to the beaders' standards of acceptability. This invention relates to a tool for reproducibly forming ear wires of a highly finished appearance from beading wire which provides ample levels of mechanical advantage so that beaders can form ear wires using very little effort. This can be especially important for beaders of advanced age.

SUMMARY OF THE INVENTION

The present invention provides a manually operable tool for bending of an ear wire blank into a configuration including an open "U" section and a smaller substantially closed loop terminating one of the uprights of the "U". The manually operable tool comprises: a pair of handles urgable together; an anvil plate having an arcuate minor forming slot, an arcuate major forming slot, a circumferential gear formed on one side of the anvil plate adjacent to the minor forming slot; and a forming anvil formed on the other side of the anvil plate; a first forming link having a downwardly projecting forming link rod projecting through the major forming slot and engagable against one side of a wire blank disposed upon the anvil plate; a second forming link having a downwardly projecting stanchion projecting therefrom and protruding through the major forming slot; each of the first and said second forming links being pivotably joined to anvil plate; a planetary gear rotatable around the downwardly projecting forming link rod on said upper forming link, the forming link rod projecting through said minor forming slot, the planetary gear being engagable against the circumferential gear and having an eccentric forming rod projecting downwardly through the minor forming slot and engaging the side of a wire blank on the anvil plate; the handles being pivotally joined to said anvil plate and urgable toward each other; and a linkage urging: the upper forming link to rotate in a first direction in response to said handles being urged toward each other; urging said lower forming link to rotate in a second direction counter to the first direction; and forcing the ear-wire blank against the forming anvil.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures.

DETAILED DESCRIPTION OF THE PREFERRED EMBODIMENT

Figure 3:
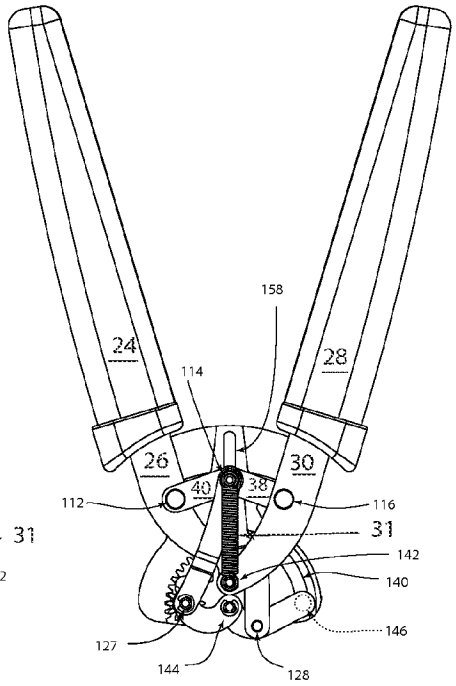
FIGS. 1, 2 and 3 are forming side, elevational and reverse views of a forming tool of the present invention, respectively.
Figure 2:
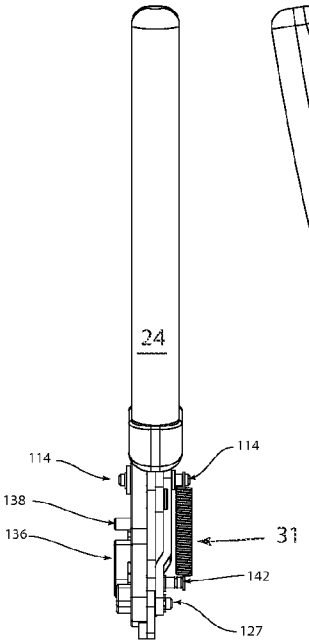
Figure 1:
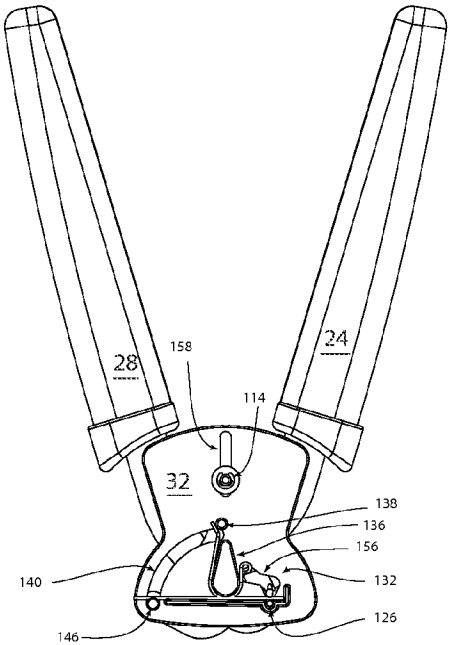
Figure 4:
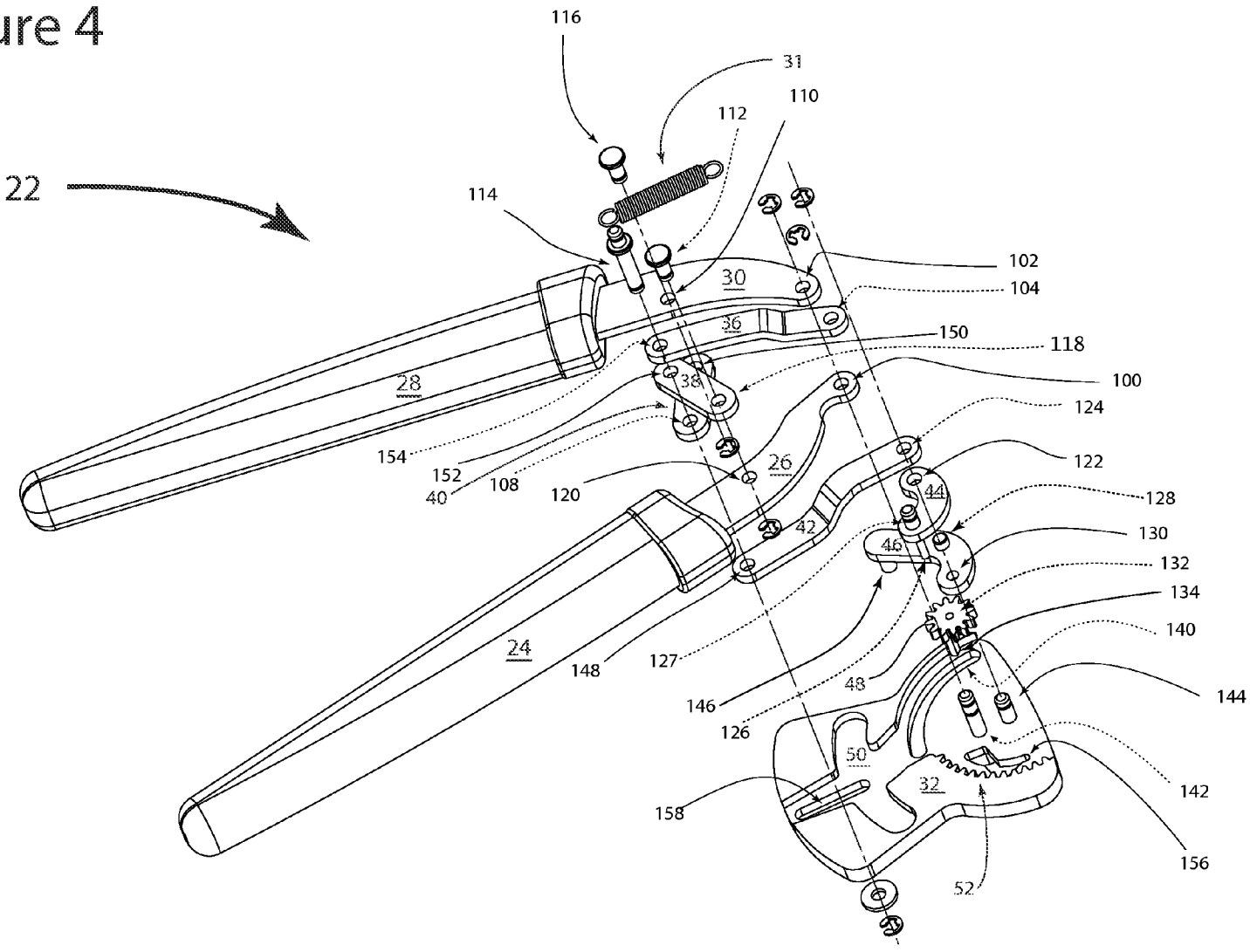
FIGS. 4 through 6 are exploded isometric perspective views of the forming tool of the present invention with FIG. 5 being an enlarged detail of FIG. 4.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

Ear wire forming tool 22 of the present invention comprises right handle 24 and left handle 28 wherein both handles 24 and 28 are preferably of substantially full tang construction so that right handle tang 26 and left handle tang 30 extend for most of the full length of handles 24 and 28 respectively leaving, of course, a cushion at the very end, providing for rigidity and the ability to accommodate the considerable mechanical advantage provided by the present invention. Handles 24 and 28 are pivotably joined to anvil plate 32 by major pivot stanchion 142 interpenetrating right handle tang 26 via right handle pivot aperture 100 and left handle tang 30 via left handle tang pivot aperture 102. For easy assembly and disassembly, major pivot stanchion 142 is capped with retaining ring 106 which restricts dislodgment of tangs 26 and 30 from major pivot stanchion 142 during use. Throughout the remainder of this specification, retaining rings will not be belabored with numbers even though illustrated in the drawings as any convenient retention means may be employed to retain pivoting structures in proper relationship to each other including integrally formed caps, cotter pins, capped screws, bolts, nuts and the like.

Lower linkage arm 40 is pivotably joined to left handle tang 30 by left linkage pin 116 passing through left handle tang linkage aperture 110 and right lower linkage arm aperture 150 in lower linkage arm 40, while upper linkage arm 38 is pivotably joined to right handle tang 26 via right linkage pin 112 passing through right upper linkage arm aperture 118 in upper linkage arm 38 and right handle tang linkage aperture 120 in right handle tang 26. Upper floating bar 36 is pivotably joined to lower floating bar 42, upper linkage arm 38 and lower linkage arm 40 via translating pin 114 passing through upper floating bar inner aperture 154, left upper linkage aperture 152, left lower linkage arm aperture 108, lower floating bar inner aperture 148 and longitudinal slot 158 in anvil plate 32. Translating pin 114 is of sufficient length that it translates fore and aft in longitudinal slot 158 in anvil plate 32, moving aft (away from major pivot stanchion 142) as right handle 24 and left handle 28 are urged together. When inward pressure is removed from handles 24 and 28, translating pin 114 is urged forwardly toward major pivot stanchion 142 by spring 31 looped over translating pin 114 at its aft end and over major pivot stanchion 142 at its other.

First terraced floating bar 36 is pivotably joined to upper forming link 44 via upper forming link stanchion 127 passing through outer aperture 104 of first terraced floating bar 36, with planetary gear 48 riding on upper forming link pin 126 which is co-axial with upper forming link stanchion 127. Upper forming link pin 126 passes through planetary gear aperture 132 with planetary gear 48 engaging circumferential gear 52 in anvil plate 32 while upper forming link pin 126 rides in minor forming slot 156 in anvil plate 32 and planetary gear forming rod 134 similarly protrudes through minor forming slot 156 in anvil plate 32. Both upper forming link 44 and lower forming link 46 are pivotably joined to anvil plate 32 via forming stanchion 144 passing through lower forming link aperture 130 as well as through upper forming link aperture 122. Second terraced floating bar 42 is pivotably connected to lower forming link 46 via lower forming link central stanchion 128 passing through lower floating bar outer aperture 124 with lower forming link left stanchion 146 riding in major forming slot 140. Note that the lower level of second terraced floating bar 42, lower forming link 46 and planetary gear 48 all are disposed within recess 50 in anvil plate 32 in one plane with lower linkage arm 40, right handle tang 26, the upper level of second terraced floating bar 42 and upper forming link 44 lying in a second plane and the lower level of first terraced floating bar 36, upper linkage arm 38, and left handle tang 30 all lying in a third plane, thereby providing a compact, efficient arrangement of a great many moving parts.

Figure 7:
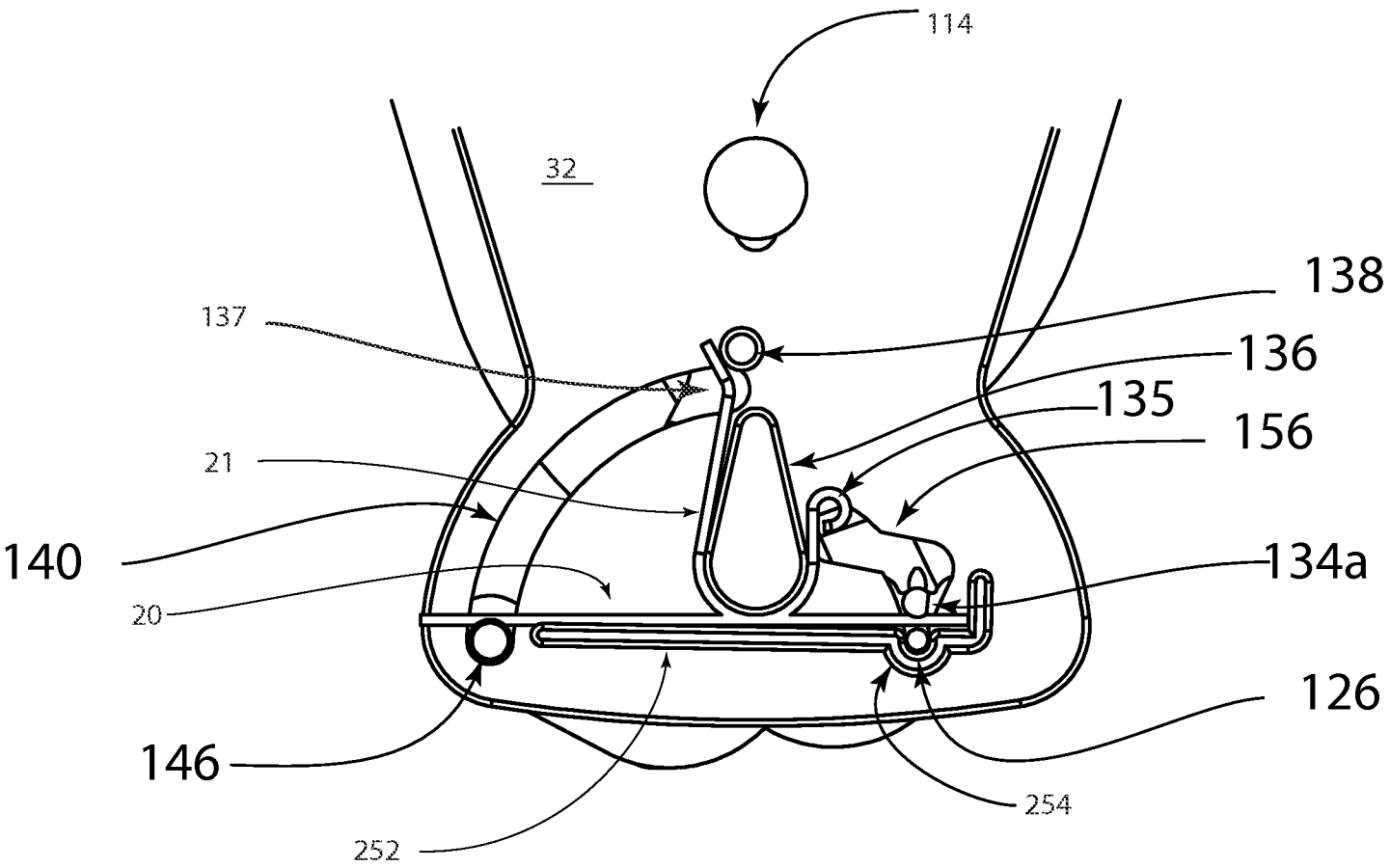
FIG. 7 is a detail of a plan view of the forming side of the anvil plate of the forming tool of the present invention.
Figure 8:
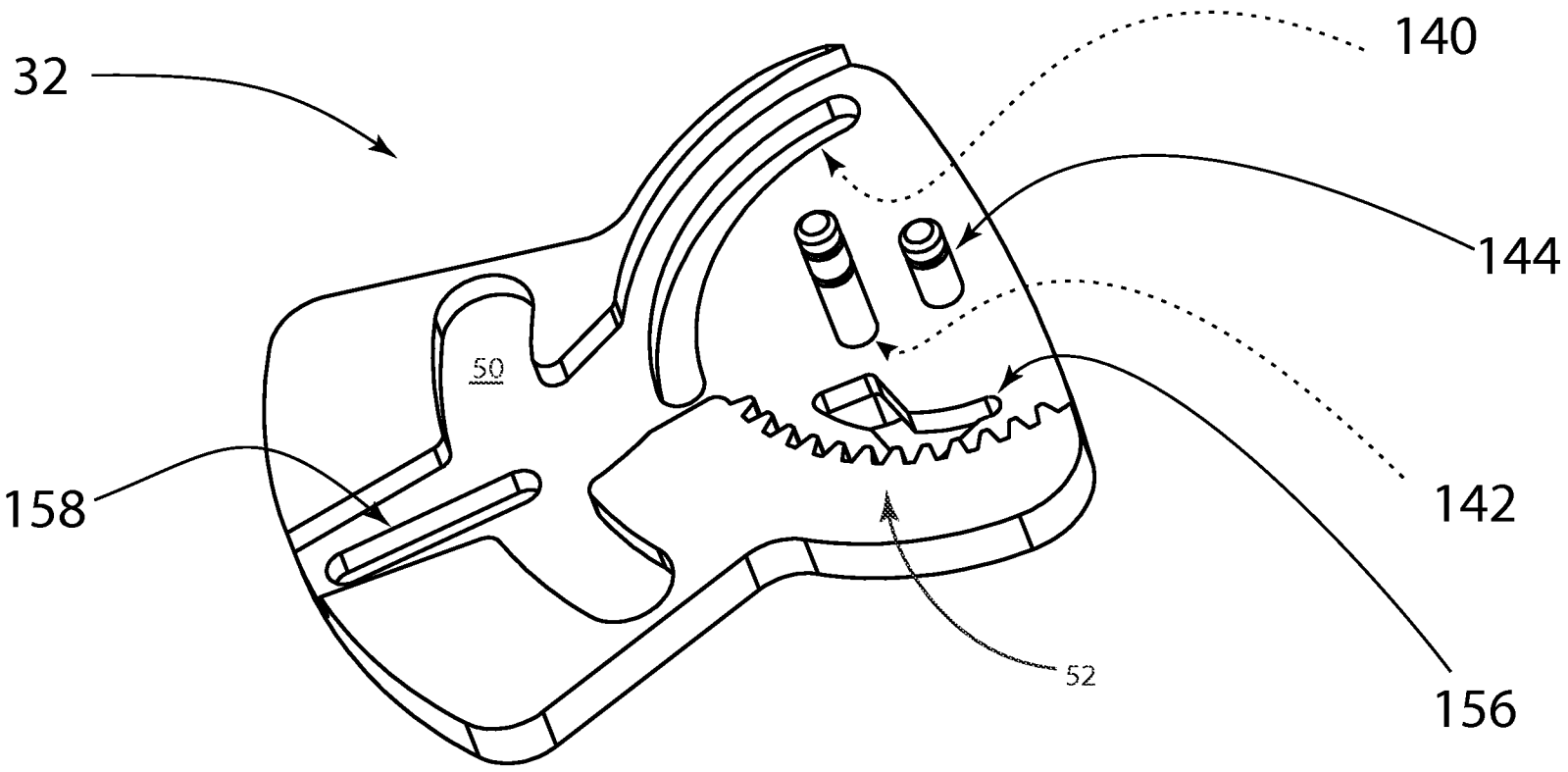
FIG. 8 is an isometric perspective of the lower side of the anvil plate of the forming tool of the present invention.
Figure 9:
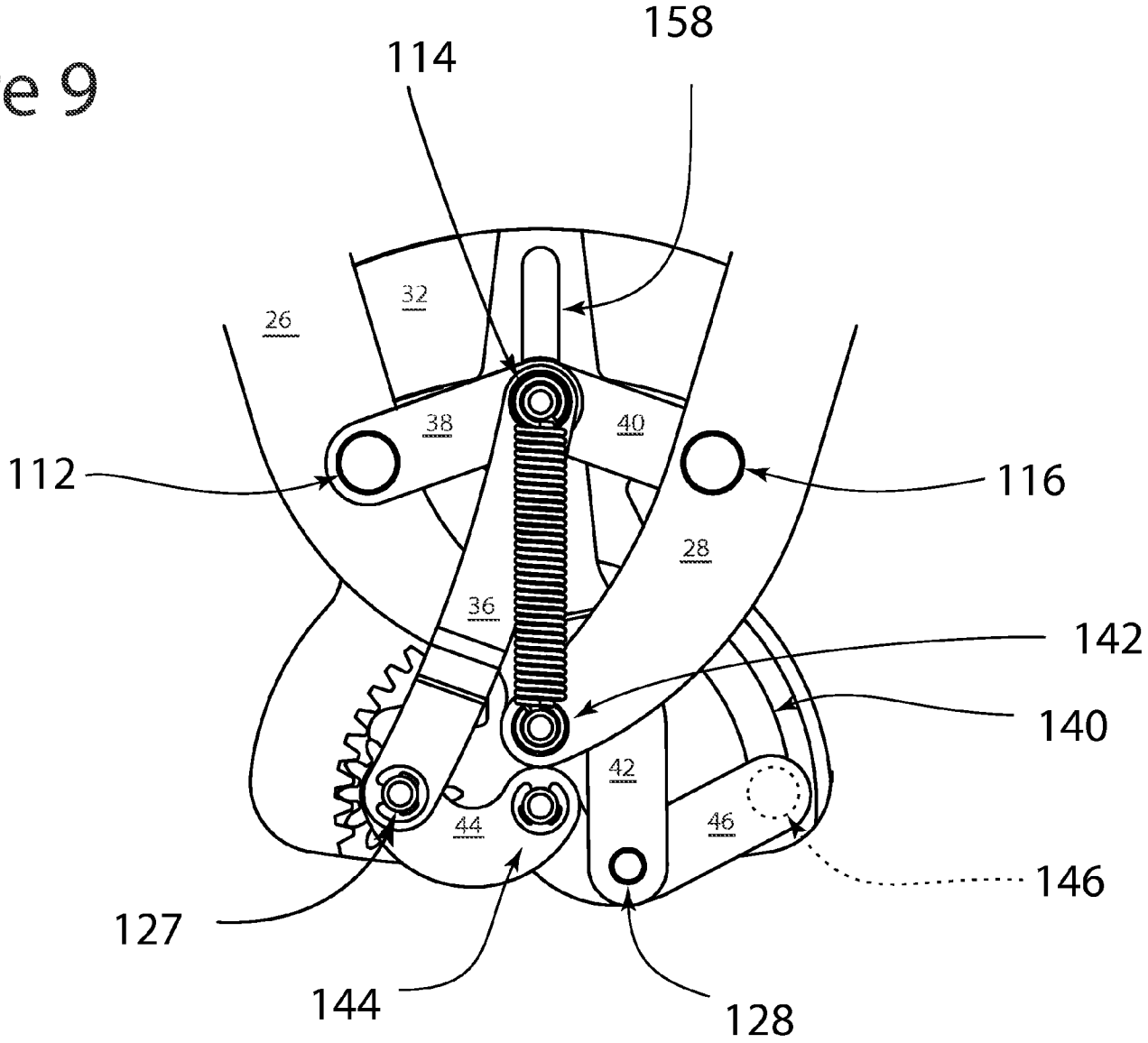
FIG. 9 is a detail of a plan view of the lower side of the forming tool of the present invention illustrating the linkages and mechanism thereof visible in the assembled tool.
Figure 10:
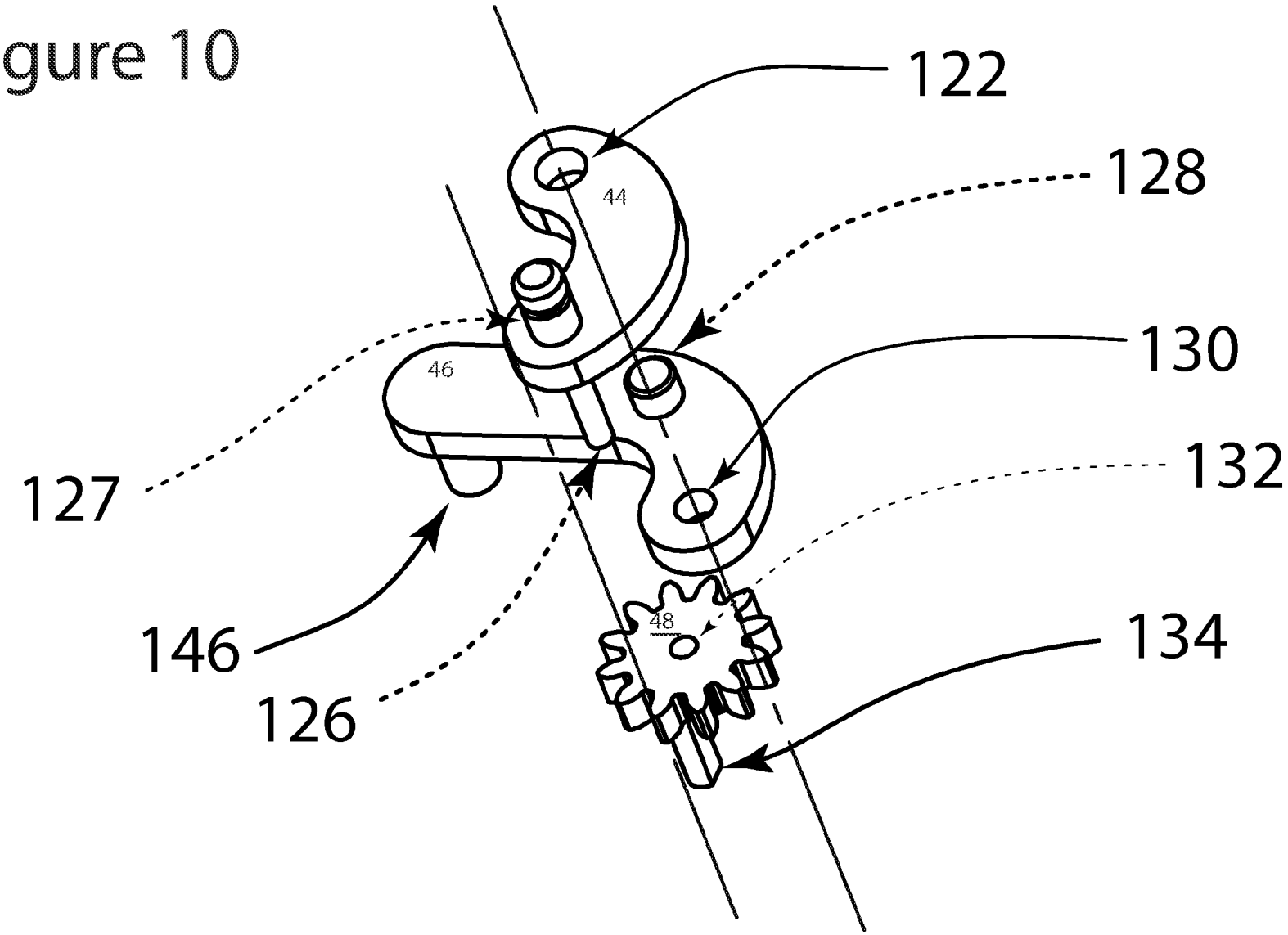
FIG. 10 is an isometric perspective of the forming linkages of the forming tool of the present invention.

As seen in FIG. 7, upper forming link pin 126, passing through planetary gear aperture 132, engages the lower side of wire 20 at recess 254 while planetary gear forming rod 134 engages the upper surface of wire 20 and lower forming link left stanchion 146 engages the lower side of wire 20 as it rests against retaining wall 252 prior to the forming operation.

Figure 5:
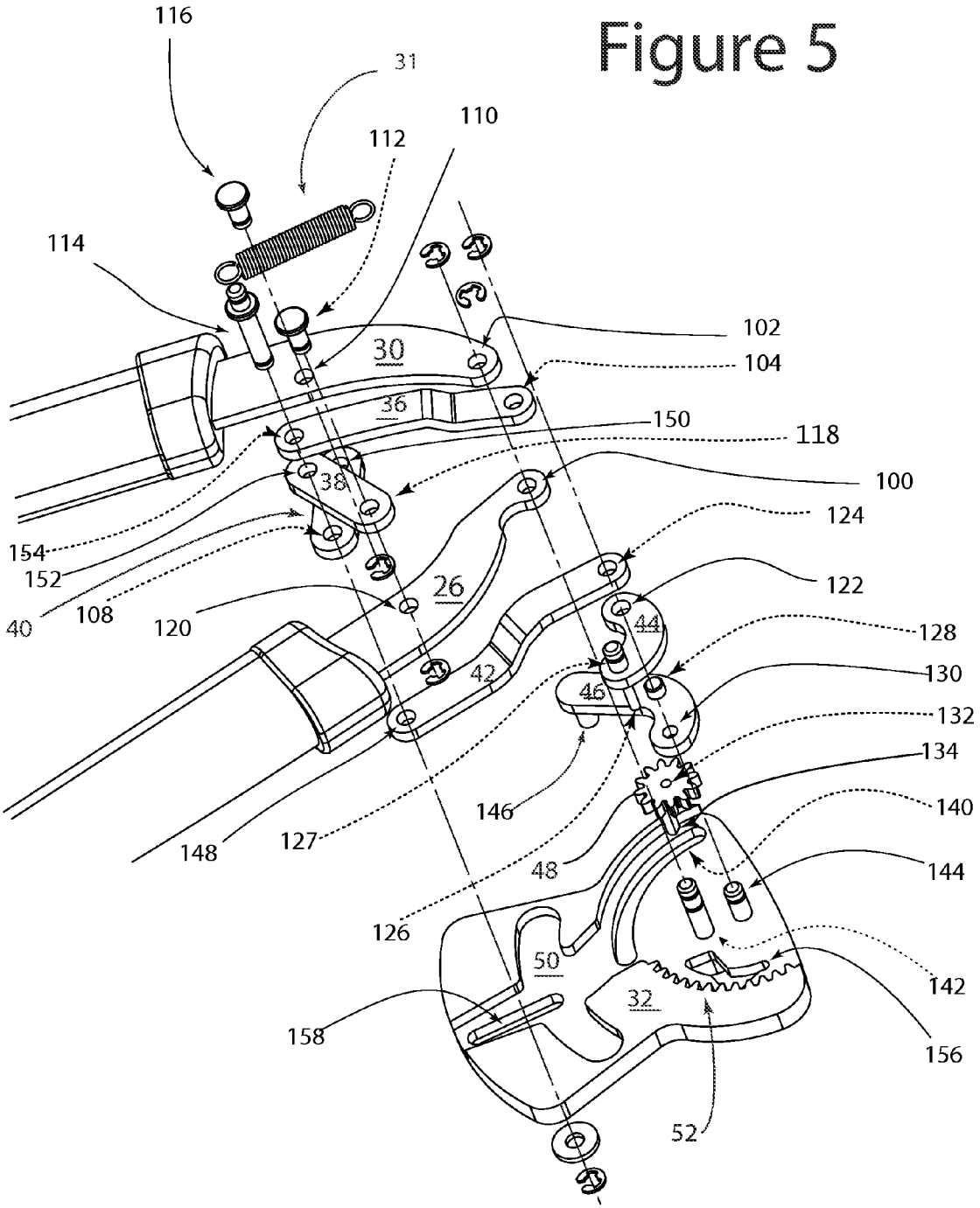
Figure 6:
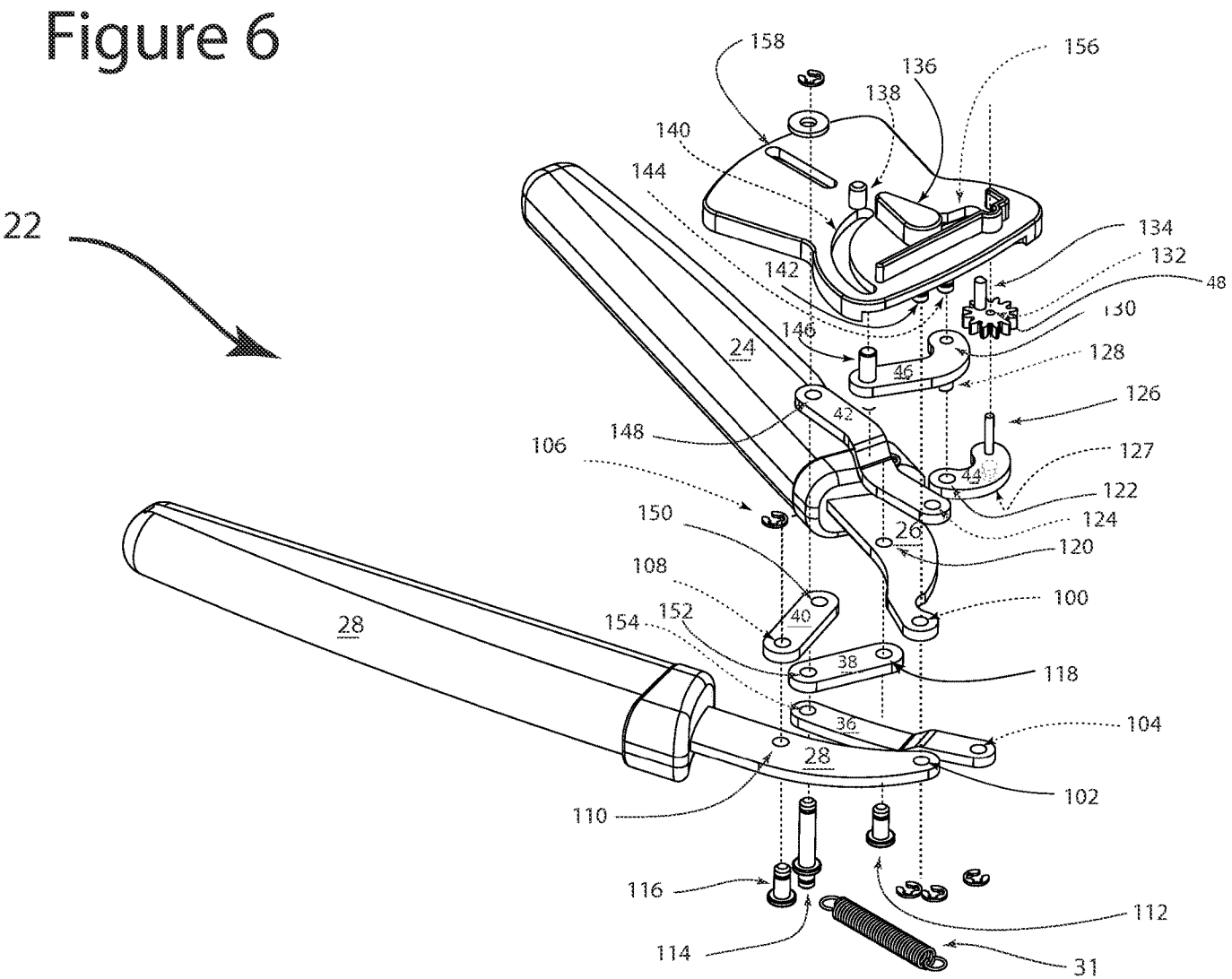
Figure 11:
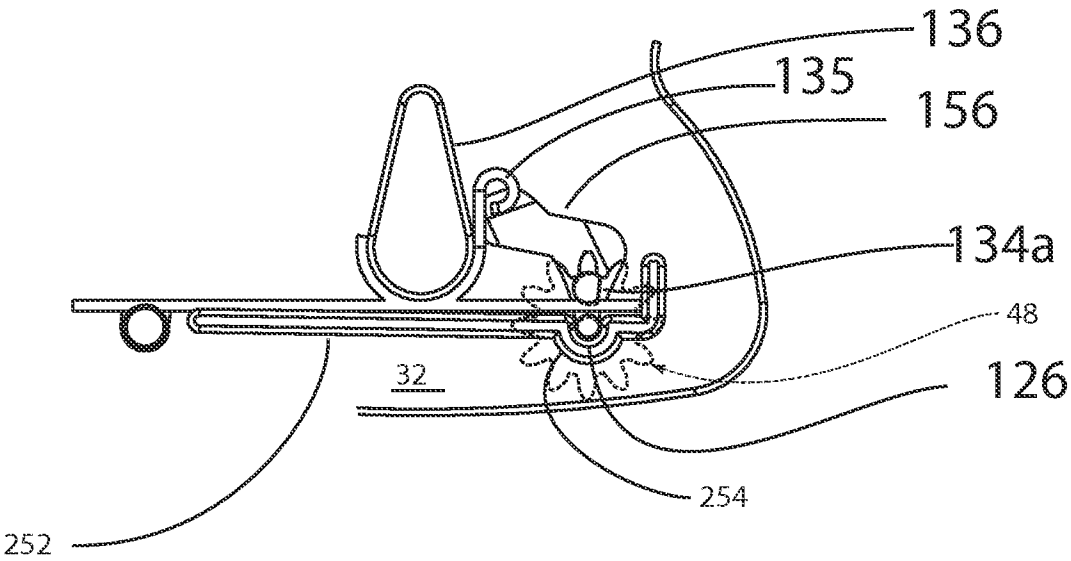
FIGS. 11-13 illustrate the details of the forming motion forming a substantially closed loop in an ear wire blank.
Figure 12:
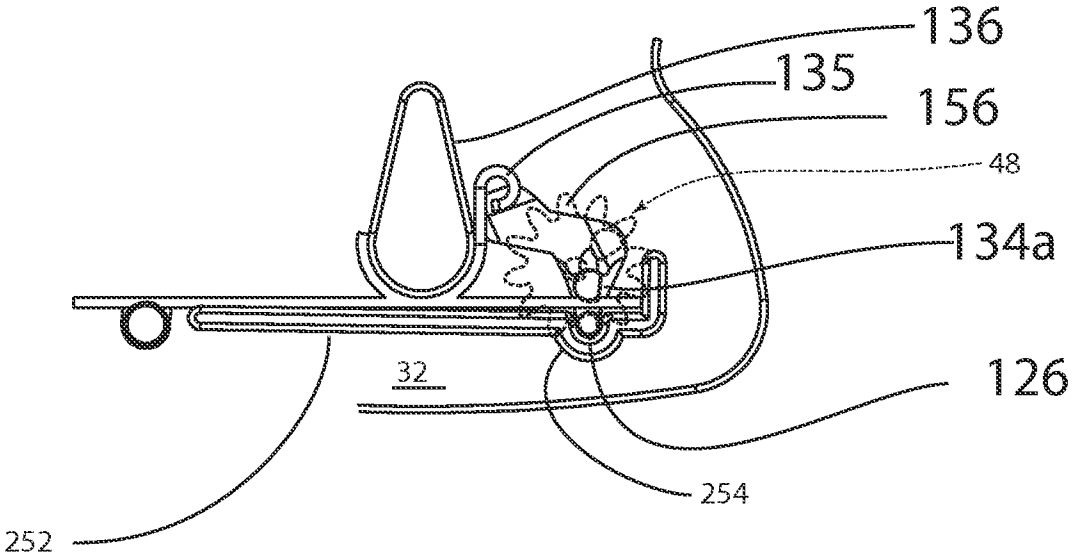
Figure 13:
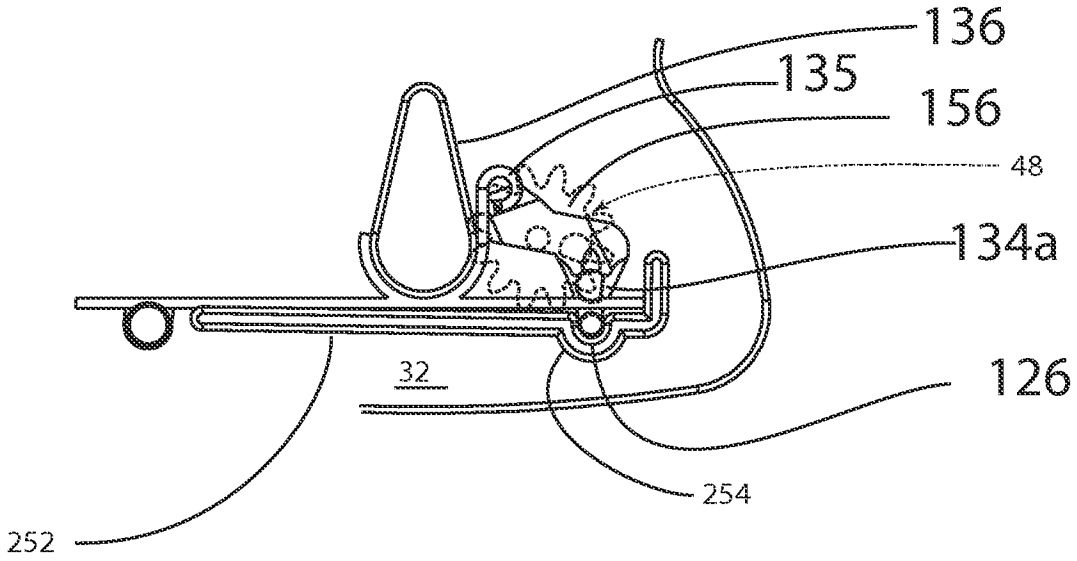
Figure 14:
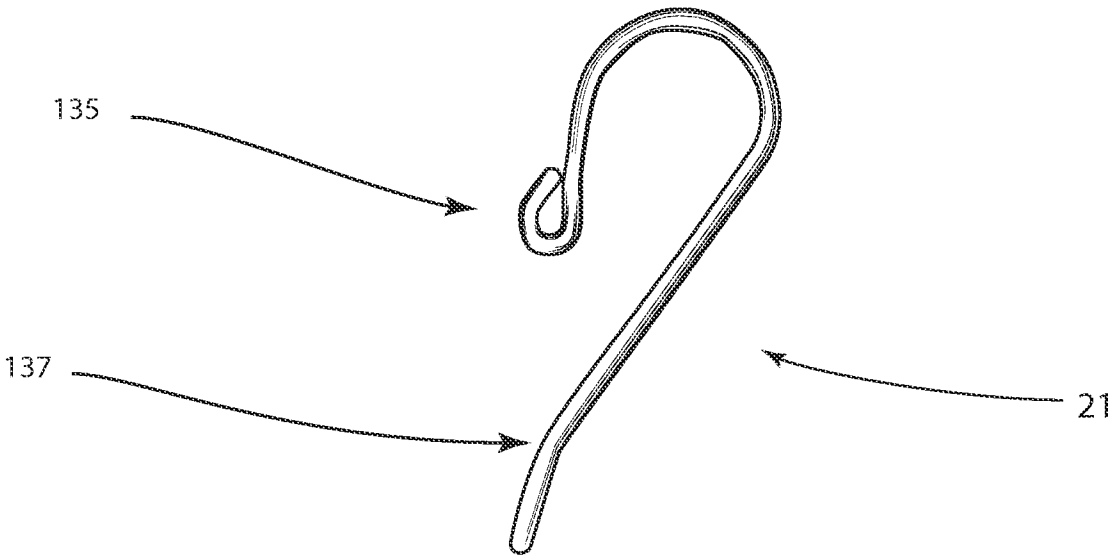
FIG. 14 illustrates an ear wire produced by the forming tool of the present invention.
Figure 15:
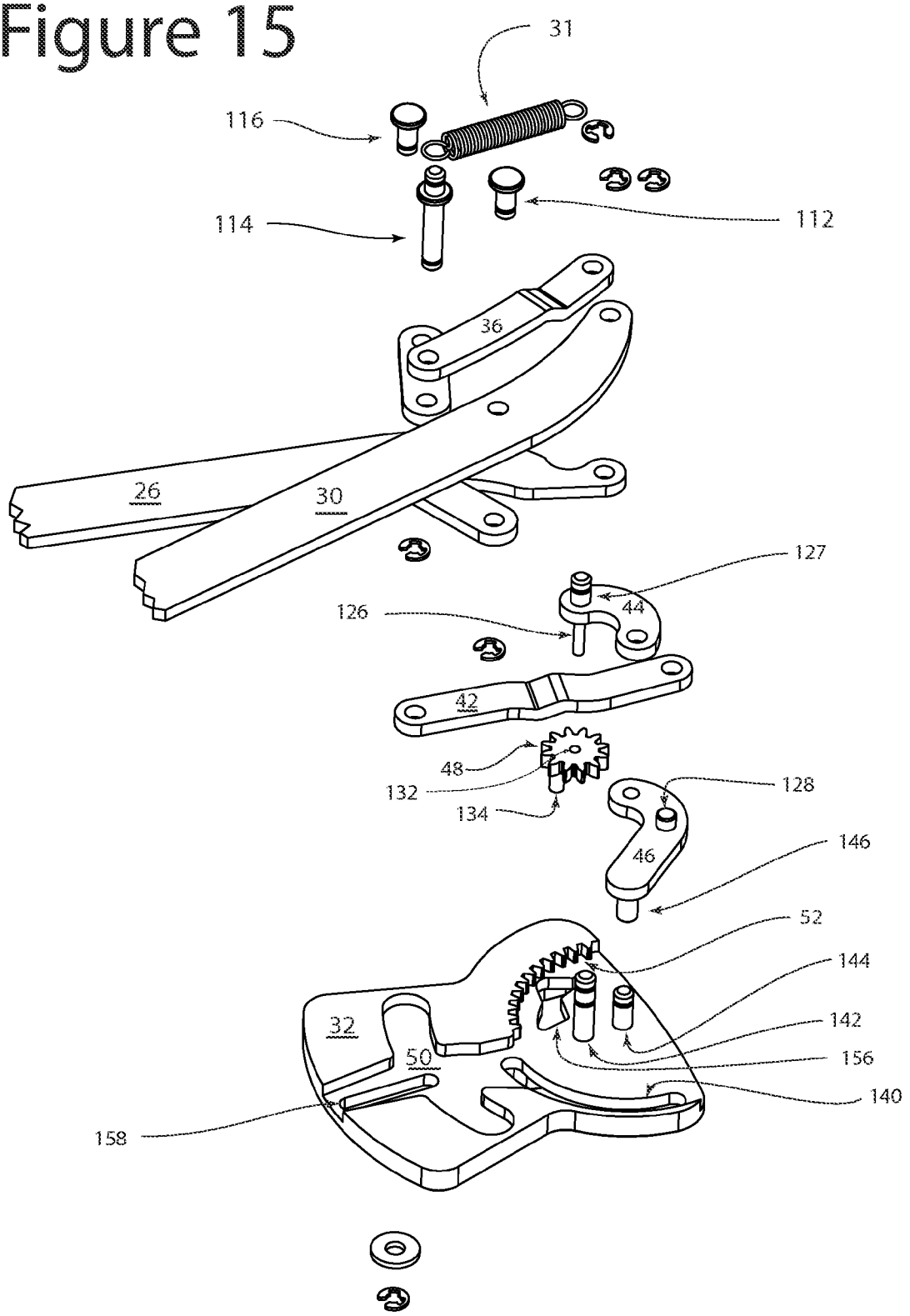
FIGS. 15 and 16 are exploded isometric perspective views of a mirror image forming tool of the present invention.
Figure 16:
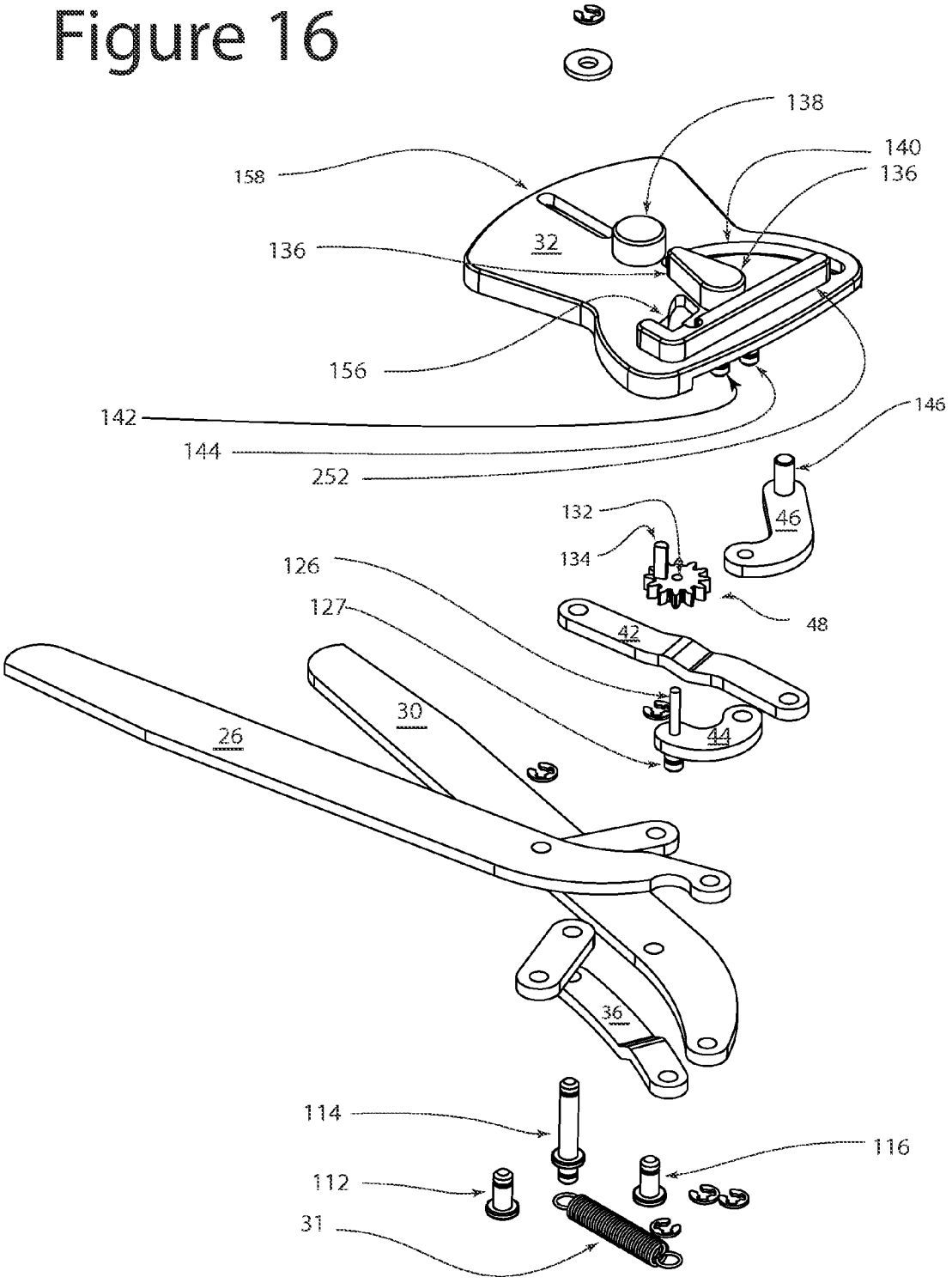

FIGS. 7 and 11-13 illustrate the operation of ear wire forming tool 22 with wire 20 initially lying against forming wall 252 with one end entrapped between upper forming link pin 126 resting in minor forming loop forming recess 254 and planetary gear forming rod 134 at location 134*a* and the other end engaging lower forming link left stanchion 146. In FIG. 11, the initial position of planetary gear 48 is shown in phantom as it lies beneath anvil plate 32. As handles 24 and 28 are urged inwardly together, translating pin 114, passing through apertures 154, 152, 108 and 148 and riding in longitudinal slot 158, is urged rearwardly against the force of spring 31. As first terraced floating bar 36 and second terraced floating bar 42 are drawn rearwardly, upper forming link stanchion 127 on upper forming link 44 is similarly drawn rearwardly, urging upper forming link pin 126 passing through planetary gear aperture 132 on planetary gear 48 to move rearwardly and inwardly as it engages circumferential gear 52 in anvil plate 32 and thereby causing planetary gear 48 to rotate counter-clockwise from the vantage point of FIG. 5, with planetary gear forming rod 134 initially following the outer most trace of minor forming slot 156 until it begins following the inner most trace at about the point adjacent the tip of arrow 156 in FIG. 7. Simultaneously, upper forming link pin 126 begins following the inner-most trace of minor forming slot 156 as shown in FIG. 12 but as shown in FIG. 13 switches over and begins following the outer-most trace. This motion of upper forming link pin 126 and planetary gear forming rod 134 wraps the right tip of wire 20 around upper forming link pin 126 forming loop 135 of formed ear wire 21 as shown in FIG. 14. Concurrently with handles 24 and 28 being urged inwardly together, lower forming link left stanchion 146 traverses major forming slot 140 and engages the lower side of wire 20 at its left end at the beginning of the forming operation and wraps wire 20 around anvil loop 136 forming bend 137 therein at the very end of the forming cycle as the left most tip thereof is pressed against anvil rod 138 thereby forming ear wire 21 as shown in FIG. 14.

In many cases, it will be possible to form most of the ear wire forming tool of the present invention almost entirely out of a polymeric material such as ABS, a relatively high molecular polyethylene, high strength nylon or any other reasonably strong material, it being of course understood that metals are in most cases more than adequate. If the election is made to use polymeric materials extensively, it may be prudent to form the planetary gear or at least the axle on which it rides out of metal.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A manually operable tool for bending of a wire into a configuration suitable for use as an ear wire including one open "U" section and a smaller substantially closed loop terminating one of the uprights of the open "U" section, said manually operable tool comprising:

(i) a first handle having a first handle pivot aperture formed therein and a first handle linkage aperture formed therein, said first handle pivot aperture being formed proximate one end of said first handle; said first handle linkage aperture being formed medially in said first handle;

(ii) a second handle having a second handle pivot aperture and a second handle linkage aperture formed therein, said second handle pivot aperture being formed proximate one end of said second handle; said second handle linkage aperture being formed medially in said second handle;

(iii) an anvil plate having:

an upright major pivot stanchion formed on one side thereof, an upright forming stanchion formed on said one side thereof, a longitudinal slot formed therethrough;

a generally arcuate minor forming slot formed therethrough;

a generally arcuate major forming slot formed therethrough;

a circumferential gear formed on said one side thereof, adjacent and exterior to said major forming slot, said circumferential gear spanning less than a full 360°;

a retaining wall formed on an other of said anvil plate; and a forming anvil formed on said other side of said anvil plate;

(iv) a first terraced floating bar having a first end and a second end;

(v) a second terraced floating bar having a first end and a second end;

(vi) an upper forming link having an upper face, a lower face, a first end and a second end having an upwardly projecting stanchion projecting from the upper face thereof and a downwardly projecting forming link pin projecting from the lower face thereof;

(vii) a lower forming link having an upper face, a lower face, a first end and a second end, said lower forming link having an upwardly projecting stanchion projecting from the upper face thereof at a location between said first and said second end, and a downwardly projecting stanchion projecting from the lower face thereof proximate said second end thereof;

(viii) an upper linkage arm having a first end and a second end;

(ix) a lower linkage arm having a first end and a second end;

(x) a translating pin; and (xi) a planetary gear having an eccentric forming rod projecting from a lower face thereof;

said major pivot stanchion interpenetrating said second handle via said second handle pivot aperture and said first handle via said first handle pivot aperture, said major pivot stanchion being capped to restrict dislodgment of said first and second handles from said major pivot stanchion;

said first end of said upper linkage arm being pivotably joined to said second handle at said second handle linkage aperture;

said second end of said lower linkage arm being pivotably joined to said first handle at said first handle linkage aperture;

said first end of said first terraced floating bar being pivotably joined to said second end of said upper linkage arm as well as said first end of said lower linkage arm and said first end of said second terraced floating bar so as to form a pivotable joint, the axis of said pivotable joint being constrained to move longitudinally in said longitudinal slot in said anvil plate;

said second end of said upper forming link being pivotably joined to said second end of said first terraced floating bar;

each of said first end of said lower forming link and said first end of said upper forming link being pivotably joined to said anvil plate along a common axis;

said second end of said second terraced floating bar being pivotably joined to a medial position of said lower forming link;

said second end of said lower forming link being constrained to trace the path of said major forming slot formed in said anvil plate and said downwardly projecting stanchion being engageable against one side of wire lying against said retaining wall on said anvil plate;

said planetary gear being rotatably joined to said forming link pin and engageing said circumferential gear in said anvil plate with eccentric planetary gear forming rod protruding through said minor forming slot in said anvil plate and being engageable against an other side of wire lying against said retaining wall on said anvil plate;

said forming link pin also protruding through said minor forming slot in said anvil plate and being engageable against said one side of wire lying against said retaining wall on said anvil plate.

2. A manually operable tool for bending of a wire into a configuration suitable for use as an ear wire including one open "U" section and a smaller substantially closed loop terminating one of the uprights of the open "U" section, said manually operable tool comprising: a first handle; a second handle; an anvil plate having a generally arcuate minor forming slot formed therethrough, a generally arcuate major forming slot formed therethrough, a circumferential gear formed on one side thereof, adjacent and exterior to said major forming slot, said circumferential gear spanning less than a full 360°; and a forming anvil formed on another side of said anvil plate; a first forming link having a downwardly projecting forming link rod projecting therefrom, said downwardly projecting forming link rod protruding through said minor forming slot and being engageable against one side of a wire disposed upon said anvil plate; a second forming link having a downwardly projecting stanchion projecting therefrom and protruding through said major forming slot; each of said first and said second forming links being pivotably joined to the anvil plate; a planetary gear rotatable around said downwardly projecting forming link rod on said first forming link, said forming link rod projecting through said minor forming slot, said planetary gear being engageable against said circumferential gear, said planetary gear having an eccentric forming rod projecting downwardly therefrom though said minor forming slot and being engageable against another side of a wire disposed upon said anvil plate; said second handle and said first handle being pivotally joined to said anvil plate and urgable toward each other; and a linkage urging said first forming link to rotate in a first direction in response to said handles being urged toward each other, urging said second forming link to rotate in a second direction counter to the first direction and forcing said wire against said forming anvil.

3. A manually operable tool for bending of a wire into a configuration suitable for use as an ear wire including one open "U" section and a smaller substantially closed loop terminating one of the uprights of the open "U" section, said manually operable tool comprising: a first handle; a second handle; an anvil plate having first and second generally arcuate forming slots formed therethrough, a circumferential gear formed on one side thereof, adjacent and exterior to said second forming slot, said circumferential gear spanning less than a full 360°; and a forming anvil formed on another side of said anvil plate; a first forming link having a downwardly projecting forming link rod projecting therefrom, said downwardly projecting forming link rod protruding through said second forming slot and being engageable against one side of a wire disposed upon said anvil plate; a second forming link having a downwardly projecting stanchion projecting therefrom and protruding through said first forming slot; each of said first and said second forming links being pivotably joined to the anvil plate; a planetary gear rotatable around said downwardly projecting forming link rod on first forming link, said forming link rod projecting through said second forming slot, said planetary gear being engageable against said circumferential gear, said planetary gear having an eccentric forming rod projecting downwardly therefrom though said second forming slot and being engageable against another side of a wire disposed upon said anvil plate; said second handle and said first handle being pivotally joined to said anvil plate and urgable toward each other; and a linkage urging said first forming link to rotate in a first direction in response to said handles being urged toward each other, urging said second forming link to rotate in a second direction counter to the first direction; and forcing said wire against said forming anvil.

4. A manually operable tool for bending of a wire into a configuration suitable for use as an ear wire including one open "U" section and a smaller substantially closed loop terminating one of the uprights of the open "U" section, said manually operable tool comprising:

(i) a first handle;

(ii) a second handle;

(iii) an anvil plate having:

a longitudinal slot formed therethrough;

a generally arcuate minor forming slot formed therethrough;

a generally arcuate major forming slot formed therethrough;

a circumferential gear formed on one side thereof, adjacent and exterior to said major forming slot, said circumferential gear spanning less than a full 360°;

a retaining wall formed on an other side of said anvil plate; and a forming anvil formed on said other side of said anvil plate;

(iv) a first terraced floating bar;

(v) a second terraced floating bar;

(vi) a first forming link having an upwardly projecting stanchion projecting therefrom and a downwardly projecting forming link rod projecting therefrom;

(vii) a second forming link having a downwardly projecting stanchion;

(viii) a upper linkage arm;

(ix) a lower linkage arm;

(x) a translating pin, and (xi) a planetary gear having an eccentric forming rod projecting from a lower face thereof;

one end of each of said second handle and said first handle being pivotably joined to said anvil plate, one end of said upper linkage arm being joined to a medial position on said first handle, one end of said lower linkage arm being pivotably joined to a medial position of said second handle, the other end of each of said upper and lower linkage arms being both pivotably joined to an end of said first and second terraced floating bars, thereby having all four pivotable about the same axis, a first end of said first forming link being pivotably joined to another end of said first terraced floating bar;

each of a first end of said second forming link and a second end of said first forming link being pivotably joined to said anvil plate along a generally coincident common axis;

a second end of said second terraced floating bar being pivotably joined to a medial position of said second forming link;

a second end of said second forming link bearing said downwardly projecting stanchion being constrained to trace the path of said major forming slot formed in said anvil plate, said downwardly projecting stanchion being engageable against one side of wire lying against said retaining wall on said anvil plate;

said planetary gear being rotatably joined to said first end of said first forming link via said forming link rod and engaging said circumferential gear in said anvil plate with said eccentric planetary gear forming rod protruding through said minor forming slot in said anvil plate and being engageable against an other side of wire lying against said retaining wall on said anvil plate;

said forming link rod also protruding through said minor forming slot in said anvil plate and being engageable against said one side of wire lying against said retaining wall on said anvil plate.

* * * * *